US007604235B2

(12) United States Patent
Wiegand

(10) Patent No.: US 7,604,235 B2
(45) Date of Patent: Oct. 20, 2009

(54) BOARD GAME TO HELP DEVELOP WORD RECOGNITION AND SPELLING SKILLS

(76) Inventor: Eric William Wiegand, 12 High St., Ilion, NY (US) 13357

( * ) Notice: Subject to any disclaimer, the term of this patent is extended or adjusted under 35 U.S.C. 154(b) by 0 days.

(21) Appl. No.: 11/160,402

(22) Filed: Jun. 22, 2005

(65) Prior Publication Data

US 2006/0290053 A1 Dec. 28, 2006

(51) Int. Cl.
*A63F 3/00* (2006.01)

(52) U.S. Cl. ..... 273/242; 273/272; 273/299

(58) Field of Classification Search ..... 273/242, 273/272, 299
See application file for complete search history.

(56) References Cited

U.S. PATENT DOCUMENTS

| | | | | | |
|---|---|---|---|---|---|
| 1,034,633 | A * | 8/1912 | Mansfield | ..... | 273/243 |
| 3,104,106 | A * | 9/1963 | Kenney et al. | ..... | 273/249 |
| 4,174,840 | A * | 11/1979 | Curtiss | ..... | 273/248 |
| 4,566,698 | A * | 1/1986 | Sneden | ..... | 273/249 |
| 4,741,538 | A * | 5/1988 | Lewis | ..... | 273/243 |
| 4,773,651 | A * | 9/1988 | Papapavlou | ..... | 273/249 |
| 4,940,239 | A * | 7/1990 | Tuttle | ..... | 273/243 |
| 4,984,805 | A * | 1/1991 | Medlock | ..... | 273/248 |
| 5,139,268 | A * | 8/1992 | Garnett | ..... | 273/249 |
| 5,505,456 | A | 4/1996 | Schmidt | | |
| 5,586,765 | A | 12/1996 | Lackey | | |
| 5,645,280 | A * | 7/1997 | Zelmer | ..... | 273/256 |
| 6,692,002 | B2 * | 2/2004 | Kummer | ..... | 273/272 |
| 6,921,074 | B2 * | 7/2005 | Cavallo | ..... | 273/272 |
| 2006/0076733 | A1 * | 4/2006 | Ritchie et al. | ..... | 273/242 |

* cited by examiner

*Primary Examiner*—Vishu K Mendiratta
(74) *Attorney, Agent, or Firm*—Weiner & Burt, P.C.; Irving M. Weiner; Pamela S. Burt

(57) ABSTRACT

A board game to help develop word recognition and spelling skills. The game includes a board having a path between a start position and a finish position for each player. Each player has a token which can be moved by forming words from letter cards, or by taking a SPELL IT challenge. The object of the game is to be the first player to get all of the player's tokens (bees) back to the player's finish position (hive).

3 Claims, 3 Drawing Sheets

Figure 1
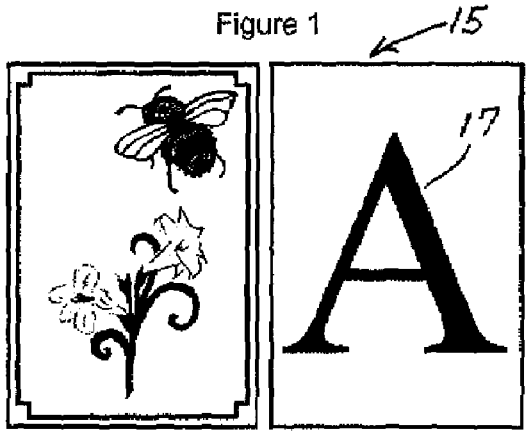
Back of Card Front of Card
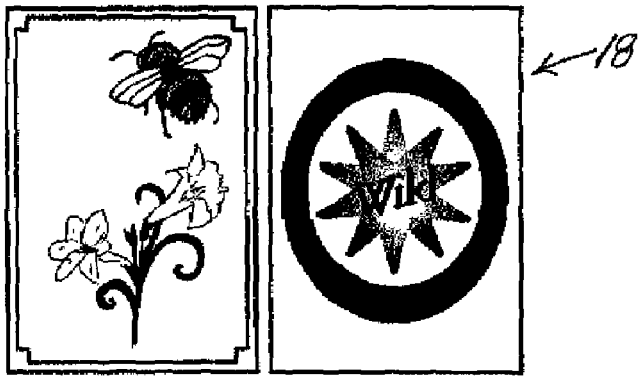
Figure 2
Figure 3
Back of Card
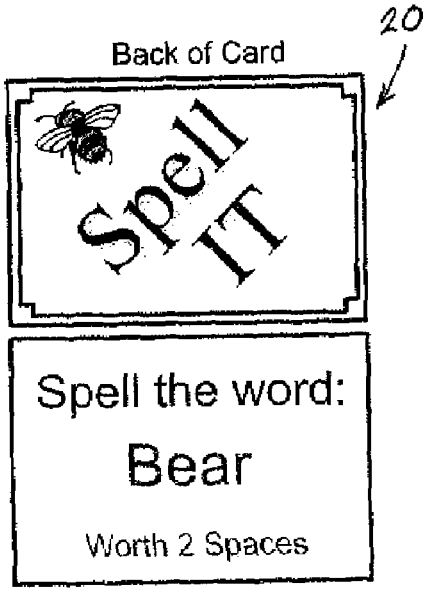
Front of Card
Figure 4
Back of Card
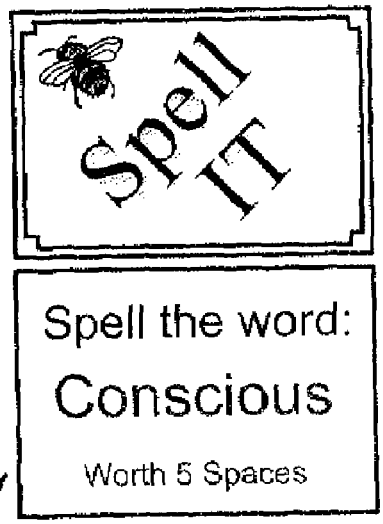
Front of Card Figure 5
Back of Card
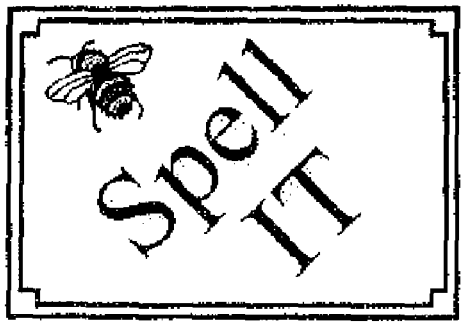
22
Spell the word:
Manageable
Worth Go Back
To Start
Front of Card
Figure 6
Back of Card
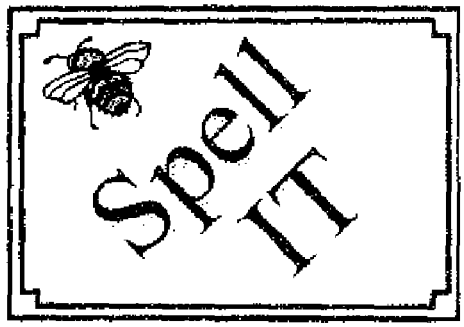
23
Challenge
Pass It
Card
Front of Card
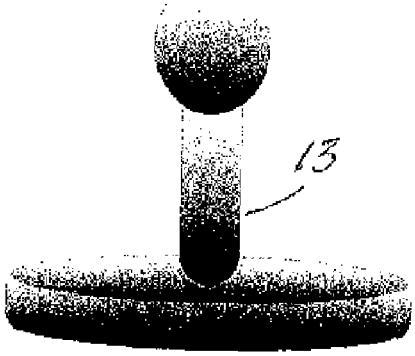
Figure 8
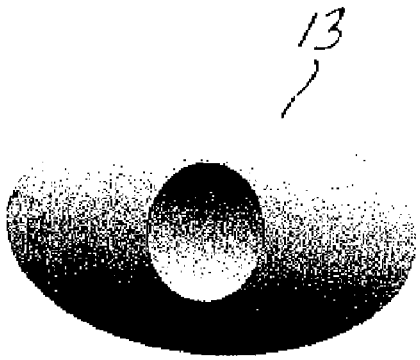
Figure 9

BOARD GAME TO HELP DEVELOP WORD RECOGNITION AND SPELLING SKILLS

The present invention relates generally to a board game to help develop word recognition and spelling skills.

More particularly, the present invention relates to a board game which enables the players to have fun arranging letters to form words, and challenging the other players to spell the words on challenge cards.

BACKGROUND OF THE INVENTION

The prior, but not necessarily relevant, art is exemplified by: Schmidt U.S. Pat. No. 5,505,456; Lackey U.S. Pat. No. 5,586,765; and Kummer U.S. Pat. No. 6,692,002.

It is a desideratum of the present invention to avoid the animadversions of the prior art and conventional board games, and at the same time provide a fun and educational game to help children and other persons develop word recognition and spelling skills.

SUMMARY OF THE INVENTION

The present invention provides a board game to help develop word recognition and spelling skills, said board game comprising: a game board including a predetermined start position for each player, a predetermined finish position for each player, and a predetermined path extending between each player's predetermined start position and that player's predetermined finish position; each said path being divided into discrete spaces; a plurality of tokens, with a predetermined number of said tokens being reserved for each player; and the number of spaces advanced by the token of each player on each turn being governed at least in part by the number of letters on letter cards that are combined to form a word by the player.

A primary object of the present invention is to provide a fun and educational spelling bee board game to help children and other persons to develop word recognition and spelling skills.

Another object of the present invention is to provide a board game as described hereinabove, by which children and other persons will have fun unscrambling letters to form words and challenging the other players to spell the words on the Spell It challenge cards.

Yet a further object of the present invention is to provide a board game as set forth hereinabove, which comprises a game board, a Spell It card deck, a letter card deck, and 16 tokens.

An additional object of the present invention is to provide a board game as set forth hereinabove, wherein the object of the game is to be the first player to get all four of his/her tokens (bees) back to the finish position (hive) and thereby winning the game.

Other objects, advantages, and features of the present invention will become more apparent to those persons skilled in this particular area of technology and to other persons after having been exposed to the following detailed description when read in conjunction with the accompanying patent drawings.

BRIEF DESCRIPTION OF THE DRAWINGS

FIG. 1 illustrates the front and back of a letter card used in the present invention.

FIG. 2 illustrates the front and back of a Wild Star letter card.

FIGS. 3, 4, 5 and 6 illustrate the front and back of exemplary SPELL IT cards used in the present invention.

FIG. 8 shows a top plan view of a token in accordance with the present invention.

FIG. 9 illustrates an elevational view of the FIG. 8 token in accordance with the present invention.

DETAILED DESCRIPTION OF SOME PREFERRED EMBODIMENTS

Figure 7:
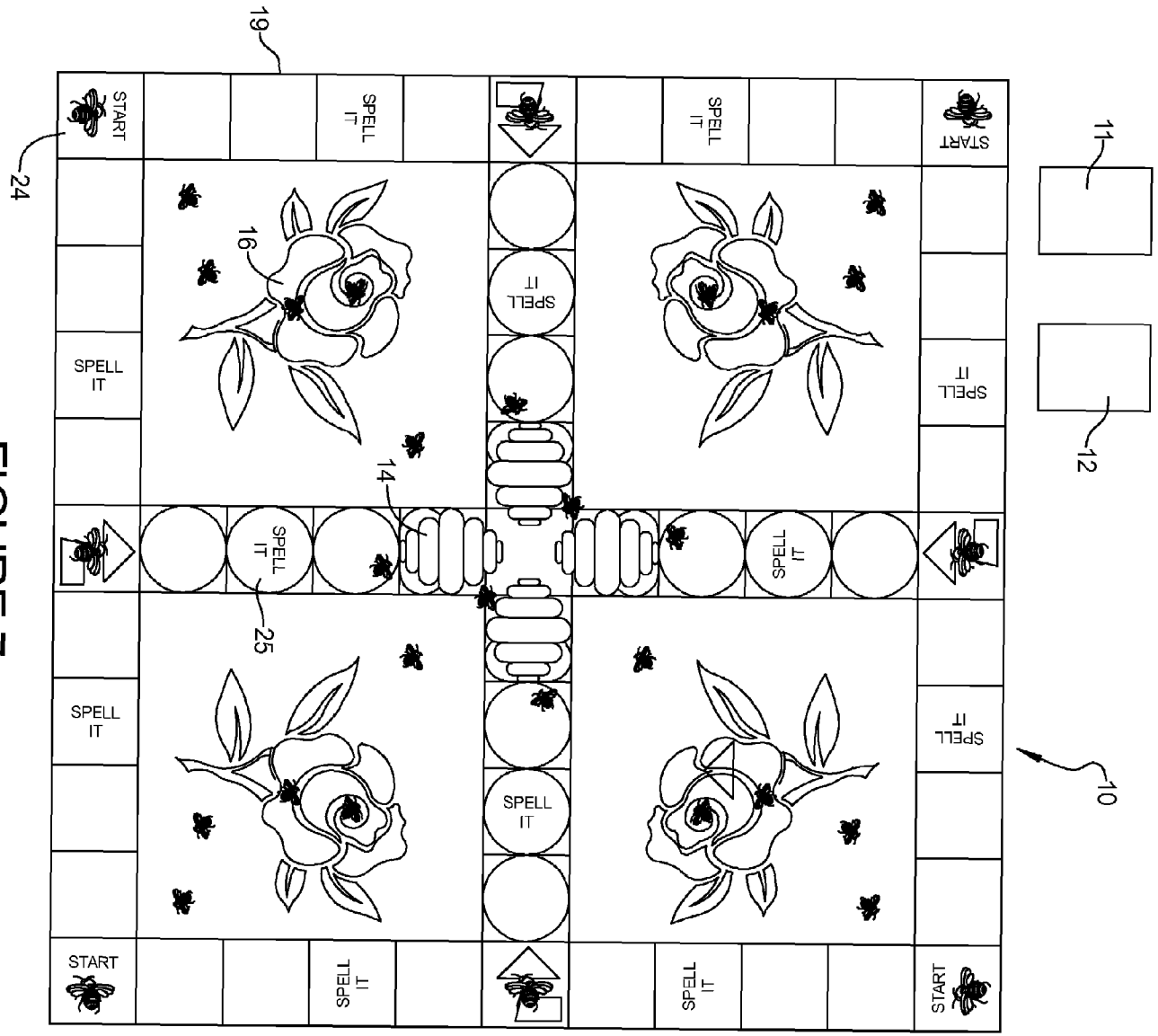
FIG. 7 shows a top plan view of a game board in accordance with a preferred embodiment of the present invention.

With reference to FIGS. 1 through 9, a preferred embodiment of the present invention will be described hereinbelow.

Preferably, but not necessarily, the board game in accordance with the present invention may be played by two to four players.

"In accordance with a preferred embodiment of the present invention, the board game includes a game board 10, a deck 11 of SPELL IT cards, e.g., 20 or 21, a deck 12 of letter cards 15, and sixteen tokens 13. As shown in FIG. 7. the game board 10 has a four-sided square shape wherein its entire perimeter is divided into a four separate straight side sections. The board 10 includes a separate predetermined start position 16 for each player, a separate predetermined start space 24 for each player. a predetermined finish position 14 for each player. and a separate predetermined path for each player extending between each player's separate predetermined start space 24 and said predetermined finish position 14. The start space 24 is positioned on the board 10 at an intersection of two of said straight side sections. The separate start position 16 comprises a separate first graphic (e.g.. the flower) located on board 10 adjacent the separate start space 24. The finish position 14 comprises a second graphic (e.g.. the hive) located on board 10 new a center portion of board 10. Each path being divided into discrete spaces 19. Each separate path extending from the separate start space 24. and from the separate start space 24 along three and one-half of the four side sections. and then to the finish position. A predetermined number of the tokens 13 (e.g.. see FIGS. 8 and 9) are reserved for each player. The tokens 13 reserved for a player are initially placed on that player's separate start position 16."

The object of the game is to be the first player to get all four of his/her tokens (bees) 13 back to a finish position (hive) 14, thereby winning the game. In order to move his/her tokens 13 around the board 10, a player must spell words using the letter cards 15 in his/her hand. The larger the word a player is able to spell, the more spaces 19 he/she can move a single token 13.

To set up the game, each player draws a letter card 15. The player with the highest letter in the alphabet goes first. Play proceeds clockwise around the board 10. Each player draws an additional six letter cards 15 so that each have a total of seven letter cards 15. At this point, play begins. The player chosen to go first spells a word and moves a token 13 from a predetermined start position (e.g., the flower) 16, counting START space 24 as his/her first move.

In game play, tokens 13 can be moved on the board 10 in two ways. The first way is by forming words with the letter cards 15. The second way is by taking a SPELL IT challenge.

To move a token 13 by forming a word with letter cards 15, the player draws letter cards 15 and spells words by arranging the letters 17 on the letter cards 15. The larger the word, the more spaces a token 13 can be moved. As an example, "A" a one-letter word, allows a player to move one space 19, while "Be" a two-letter word allows the player to move two spaces 19, and "Cat" a three-letter word allows the player to move three spaces 19. A Wild Star card 18 can be used as any letter of the alphabet.

At the beginning of his/her turn, a player must have seven letter cards 15 in his/her hand. Once a word is spelled, the player will draw the number of letter cards 15 used to spell the word from the letter card deck 12, returning that player's hand of letter cards 15 to a total of seven.

A player who uses all seven of the letter cards 15 in his/her hand receives a bonus of ten spaces 19 to move his/her token 13 and can, if he/she wishes, split the moves between all four of his/her tokens 13, in whatever numeric pattern desired.

A player who is unable to spell a word forfeits a turn, after discarding either one, two or three letter cards 15 and drawing replacement cards 15 from the deck 12. The player chooses how many and which cards 15 to discard. If no cards 15 are left in the active play pile 12, the discard pile is shuffled and placed back in active play.

The letter card deck 12 consists of 56 cards in the following format:

| |
|---|
| A-3 cards |
| B-2 cards |
| C-2 cards |
| D-2 cards |
| E-3 cards |
| F-1 card |
| G-2 cards |
| H-1 card |
| I-3 cards |
| J-1 card |
| K-1 card |
| L-3 cards |
| M-3 cards |
| N-3 cards |
| O-3 cards |
| P-1 card |
| Q-1 card |
| R-3 cards |
| S-3 cards |
| T-3 cards |
| U-2 cards |
| V-1 card |
| W-1 card |
| X-1 card |
| Y-1 card |
| Z-1 card |
| Wild Star - 4 cards |

When a token 13 lands on a SPELL IT space 25 on the game board 10, the player draws a SPELL IT card 20 or 21 and can challenge any other player to spell the word on the SPELL IT card 20 or 21. Each SPELL IT card 20 or 21 is worth a number of movement spaces 19 between one and five, which are listed below each word on the SPELL IT card 20 or 21. As an example, the word "ANT" is worth three spaces 19.

If the challenged player spells the word correctly, he/she can move a token 13 the number of spaces 19 the card 20 or 21 is worth on the game board 10. If the challenged player spells the word incorrectly, then the player acting as challenger can move one of his/her tokens 13 the number of spaces 19 the card 20 or 21 is worth.

The SPELL IT deck 11 also includes two special types of cards; four Go Back To Start cards 22, and four Pass It cards 23.

If a player draws a Go Back To Start card 22, the stakes of the challenge increase for both the player drawing the card 22 and the player being challenged. If the challenged player can correctly spell the word on the card 22, the challenged player selects one of the challenger's tokens 13 to go back to the predetermined start position 16. If the word on the card 22 is spelled incorrectly, the challenged player must send a token 13, chosen by the challenger, back to the predetermined start position 16. Tokens 13 which have already arrived at the predetermined finish location (the hive) 14 cannot be sent back to start 16 and are considered "safe".

At any time a word is misspelled, requiring a player to move a token 13 back a given number of spaces 19 toward the predetermined start position 16, it should be noted that the token 13 cannot be moved passed the predetermined start position 16. If additional moves are required, a first token 13 is moved to the predetermined start position 16 and a second token 13 moved the balance of the number of spaces 19 required.

If a player draws a Pass It card 23, he/she may keep it aside until a SPELL IT challenge. When challenged, the player has the option of accepting the challenge or playing the Pass It card 23 to avoid spelling the word on the SPELL IT card without penalty. Playing the Pass It card 23 allows the challenged player to choose a different player to take the challenge and attempt to spell the word on the SPELL IT card 20 or 21. Play continues as described hereinabove between the new challenged player and the challenger.

It should be noted that when only two players are playing the game, the Pass It card 23 stops the challenge, and game play continues as normal, proceeding to the next player's turn.

Alternative game styles can be played, including: adding additional booster packs of Spell It Challenge cards for specific grade levels or mixed levels; changing the number of tokens used from four to three or even two tokens; doubling the listed word values including words being spelled by players, the bonus for using all seven letters and the SPELL It challenge space values; implementing an alternate SPELL IT challenge wherein if the challenged player spells the word incorrectly, the challenged player must move a token 13 chosen by the challenger back the number of spaces 19 the card 20 or 21 is worth; different combinations of alternatives listed hereinabove.

There will now be described a deck of SPELL IT challenge words to be used for play by players in school grades 2 to 6. Each pack, regardless of its age or grade level and all multi-age packs contain four Pass It cards 23, four spelling words with a worth of "go back to start" and 44 spelling words worth various spaces 19.

A deck 11 of SPELL IT challenge words for use for play by players in school grades 2 to 6 would include the following words with a worth of two spaces 19: drum, eye, song, mouth, fit, bear, whole, mend, cried, staff, goose, pure.

The deck 11 of SPELL IT challenge words would also include the following words with a worth of three spaces 19: elbow, mitten, blanket, churn, unlock, agree, rabbit, rough, noisy, cellar, ivory, coach.

The deck 11 of SPELL IT challenge words would also include the following words with a worth of four spaces 19: inquire, source, cracker, quilt, socket, ignore, garbage, railway, guitar, activity.

The deck 11 of SPELL IT challenge words would also include the following words with a worth of five spaces 19: invention, newspaper, infinite, conscious, faucet, cabbage, concern, dessert, enterprise.

The deck 11 of SPELL IT challenge words would also include the following words with a worth of "go back to start": manageable, requirement, significance, judgment.

The deck 11 of SPELL IT challenge words would also include four Pass It cards 23.

There have been illustrated in the accompanying drawings and described hereinabove only several preferred embodiments of the present invention which can be varied.

It should be understood that many changes, modifications, variations, and other uses and applications will become apparent to those persons skilled in this particular area of technology and to other persons after having been exposed to the present patent specification and accompanying patent drawings.

Any and all such changes, modifications, variations, and other uses and applications which do not depart from the spirit and scope of the present invention are therefore covered by and embraced within the present invention and patent application.

What is claimed is:

1. A method of playing a board game which includes a game board having a first straight perimeter edge, a second straight perimeter edge, a third straight perimeter edge, and a fourth straight perimeter edge; said first straight perimeter edge, said second straight perimeter edge, said third straight perimeter edge, and said fourth straight perimeter edge being arranged in a square so that said game board is in the shape of said square; a first start space located on said game board contiguous with an intersection of said first straight perimeter edge and said second straight perimeter edge; a second start space located on said game board contiguous with an intersection of said second straight perimeter edge and said third straight perimeter edge; a third start space located on said game board contiguous with an intersection of said third straight perimeter edge and said fourth straight perimeter edge; a fourth start space located on said game board contiguous with an intersection of said fourth straight perimeter edge and said first straight perimeter edge; a first start position located on said game board adjacent to said first start space; a second start position located on said game board adjacent to said second start space; a third start position located on said game board adjacent to said third start space; a fourth start position located on said game board adjacent to said fourth start space; a finish position located on said game board at a center portion of said game board; said game board including a first path divided into discrete spaces and extending from said first start position, along the entire length of and contiguous with said second, third and fourth straight perimeter edges, and along only half the length of and contiguous with said first straight perimeter edge, and then centrally to said finish position; said game board including a second path divided into discrete spaces and extending from said second start position, along the entire length of and contiguous with said third, fourth and first straight perimeter edges, and along only half the length of and contiguous with said second straight perimeter edge, and then centrally to said finish position; said game board including a third path divided into discrete spaces and extending from said third start position, along the entire length of and contiguous with said fourth, first and second straight perimeter edges, and along only half the length of and contiguous with said third straight perimeter edge, and then centrally to said finish position; said game board including a fourth path divided into discrete spaces and extending from said fourth start position, along the entire length of and contiguous with said first, second and third straight perimeter edges, and along only half the length of and contiguous with said fourth straight perimeter edge, and then centrally to said finish position; said first, second, third and fourth paths overlapping predetermined portions of each other which are contiguous with the straight perimeter edges; a first plurality of movable token members reserved for a first player; a second plurality of movable token members reserved for a second player; a third plurality of movable token members reserved for a third player; a fourth plurality of movable token members reserved for a fourth player; a first plurality of cards including first cards with a letter of the alphabet appearing on a surface of each said first card; each letter of the alphabet appearing on at least one of said first cards; and the number of discrete spaces advanced by the token members of each player being governed at least in part by the number of letters appearing on said first cards that are combined to form a word by the player; the method comprising the steps of:

a) placing said first plurality of movable token members in said first start position;

b) placing said second plurality of movable token members in said second start position;

c) placing said third plurality of movable token members in said third start position;

d) placing said fourth plurality of movable token members in said fourth start position;

e) drawing one of said first cards by each player to determine which player goes first, the player drawing the highest letter in the alphabet going first;

f) drawing an additional six of said first cards so that each player has seven of said first cards;

g) spelling a first word by the player going first;

h) moving one of said token members, from the start position of the player going first, a number of the discrete spaces corresponding to the number of letters in the spelled first word, along the path of the player going first, counting the start space of the player going first as that player's first discrete space along the path of the player going first;

i) drawing additional first cards so that the player who has used first cards to spell the first word again has seven of said first cards; and j) continuing the above steps g), h) and i) by other players clockwise around said game board until all of the token members of one of the players have moved along all of the discrete spaces of that player's path and entered said finish position making that player the winner of said board game.

2. A method according to claim 1, wherein said board game is provided with a second plurality of cards including second cards, each of which second card includes a word and a number of discrete spaces assigned to such word; a plurality of challenge spaces forming part of said discrete spaces of said paths; and the number of discrete spaces advanced by the token members of each player being governed at least in part by said number of discrete spaces assigned to such word, and at least in part by said number of letters appearing on said first cards that are combined to form a word by the player; and including the steps of;

k) drawing one of said second cards when one of the token members of a player lands on one of the challenge spaces;

l) challenging any other player to spell the word on the drawn second card;

m) moving one of the token members of the challenged player the number of discrete spaces assigned to such word along the path of the challenged player if the challenged player correctly spells the word on the drawn second card; and n) moving one of the token members of the challenging player the number of discrete spaces assigned to such word along the path of the challenging player if the challenged player incorrectly spells the word on the drawn second card.

3. A method of playing a board game which includes a game board having a first straight perimeter edge, a second straight perimeter edge, a third straight perimeter edge, and a fourth straight perimeter edge; said first straight perimeter edge, said second straight perimeter edge, said third straight perimeter edge, and said fourth straight perimeter edge being arranged in a square so that said game board is in the shape of said square; a first plurality of movable token members reserved for a first player; a second plurality of movable token members reserved for a second player; a third plurality of movable token members reserved for a third player; a fourth plurality of movable token members reserved for a fourth player; a first plurality of cards including first cards with a letter of the alphabet appearing on a surface of each said first card; each letter of the alphabet appearing on at least one of said first cards; a first start space located on said game board contiguous with an intersection of said first straight perimeter edge and said second straight perimeter edge; a second start space located on said game board contiguous with an intersection of said second straight perimeter edge and said third straight perimeter edge; a third start space located on said game board contiguous with an intersection of said third straight perimeter edge and said fourth straight perimeter edge; a fourth start space located on said game board contiguous with an intersection of said fourth straight perimeter edge and said first straight perimeter edge; a first start position located on said game board adjacent to said first start space; said first plurality of movable token members reserved for the first player commence play on said first start position; a second start position located on said game board adjacent to said second start space; said second plurality of movable token members reserved for the second player commence play on said second start position; a third start position located on said game board adjacent to said third start space; said third plurality of movable token members reserved for the third player commence play on said third start position; a fourth start position located on said game board adjacent to said fourth start space; said fourth plurality of movable token members reserved for the fourth player commence play on said fourth start position; a finish position located on said game board at a center portion of said game board; said game board including a first path extending from said first start position, to said first start space, and then along the entire length of and contiguous with said second, third and fourth straight perimeter edges, and then along only half the length of and contiguous with said first straight perimeter edge, and then directly and centrally to said finish position; said first plurality of movable token members being permitted to move only along said first path; said first path being divided into discrete spaces except for said first start position; said game board including a second path extending from said second start position, to said second start space, and then along the entire length of and contiguous with said third, fourth and first straight perimeter edges, and then along only half the length of and contiguous with said second straight perimeter edge, and then directly and centrally to said finish position; said second plurality of movable token members being permitted to move only along said second path; said second path being divided into discrete spaces except for said second start position; said game board including a third path extending from said third start position, to said start space, and then along the entire length of and contiguous with said fourth, first and second straight perimeter edges, and then along only half the length of and contiguous with said third straight perimeter edge, and then directly and centrally to said finish position; said third plurality of movable token members being permitted to move only along said third path; said third path being divided into discrete spaces except for said third start position; said game board including a fourth path extending from said fourth start position, to said fourth start space, and then along the entire length of and contiguous with said first, second and third straight perimeter edges, and then along only half the length of and contiguous with said fourth straight perimeter edge, and then directly and centrally to said finish position; said fourth plurality of movable token members being permitted to move only along said fourth path; said fourth path being divided into discrete spaces except for said fourth start position; said first, second, third and fourth paths overlapping predetermined portions of each other which are contiguous with the straight perimeter edges; the number of discrete spaces advanced by the token members of each player being governed at least in part by the number of letters appearing on said first cards that are combined to form a word by the player; a second plurality of cards including second cards, each of which second card includes a word and a number of discrete spaces assigned to such word; a plurality of challenge spaces forming part of said discrete spaces of said paths; the number of discrete spaces advanced by the token members of each player being governed at least in part by said number of discrete spaces assigned to such word, and at least in part by said number of letters appearing on said first cards that are combined to form a word by the player; and all portions of said paths except for said start positions are disposed parallel or perpendicular to said first straight perimeter edge, said second straight perimeter edge, said third straight perimeter edge, and said fourth straight perimeter edge of said game board; said method comprising the steps of:

a) placing said first plurality of movable token members in said first start position;

b) placing said second plurality of movable token members in said second start position;

c) placing said third plurality of movable token members in said third start position;

d) placing said fourth plurality of movable token members in said fourth start position;

e) drawing one of said first cards by each player to determine which player goes first, the player drawing the highest letter in the alphabet going first;

f) drawing an additional six of said first cards so that each player has seven of said first cards;

g) spelling a first word by the player going first;

h) moving one of said token members, from the start position of the player going first, a number of the discrete spaces corresponding to the number of letters in the spelled first word, along the path of the player going first, counting the start space of the player going first as that player's first discrete space along the path of the player going first;

i) drawing additional first cards so that the player who has used first cards to spell the first word again has seven of said first cards; and j) continuing the above steps g), h) and i) by other players clockwise around said game board until all of the token members of one of the players have moved along all of the discrete spaces of that player'path and entered said finish position making that player the winner of said board game;

k) drawing one of said second cards when one of the token members of a player lands on one of the challenge spaces;

l) challenging any other player to spell the word on the drawn second card;

m) moving one of the token members of the challenged player the number of discrete spaces assigned to such word along the path of the challenged player if the challenged player correctly spells the word on the drawn second card; and n) moving one of the token members of the challenging player the number of discrete spaces assigned to such word along the path of the challenging player if the challenged player incorrectly spells the word on the drawn second card.

* * * * *